United States Patent [19]

Swiatek

[11] 4,225,321

[45] Sep. 30, 1980

[54] HEAT SET AND DESTRETCHED POLYESTER BACKING MATERIAL IN COATED ABRASIVE MANUFACTURE

[75] Inventor: Henry J. Swiatek, Grand Island, N.Y.

[73] Assignee: The Carborundum Company, Niagara Falls, N.Y.

[21] Appl. No.: 868,235

[22] Filed: Jan. 9, 1978

Related U.S. Application Data

[63] Continuation of Ser. No. 654,328, Feb. 2, 1976, abandoned.

[51] Int. Cl.[2] ..... B24D 11/02

[52] U.S. Cl. ..... 51/295; 51/297; 51/298; 428/241; 428/265; 428/272

[58] Field of Search ..... 51/298, 293, 295, 297; 428/241, 265, 272

[56] References Cited

U.S. PATENT DOCUMENTS

| | | | |
|---|---|---|---|
| 3,044,891 | 7/1962 | Lauchenauer | 51/298 |
| 3,180,001 | 4/1965 | Nash | 51/293 |
| 3,316,072 | 4/1967 | Voss | 51/295 |
| 3,466,814 | 9/1969 | Singer et al. | 51/298 |
| 3,665,660 | 5/1972 | Malloy et al. | 51/293 |
| 3,763,604 | 10/1973 | Malloy et al. | 51/293 |
| 3,787,273 | 1/1974 | Okrepkie et al. | 51/295 |
| 3,861,892 | 1/1975 | Wisdom et al. | 51/298 |
| 4,035,961 | 7/1977 | Pemrick et al. | 51/295 |

*Primary Examiner*—Donald J. Arnold

*Attorney, Agent, or Firm*—David E. Dougherty; Robert C. Weber

[57] ABSTRACT

A coated abrasive belt backing material woven from 100% high tenacity polyester staple yarns in a sateen weave is heat set and destretched to a dimensional stability warpwise of less than 6.5% elongation at 170 pounds per linear inch of width tensile, while maintaining its desired width during such heat setting and destretching, cloth finished, coated with maker, abrasive and size, cured and product finished to form endless belts having superior properties of strength, toughness, body retention, pliability and base adhesion.

4 Claims, 7 Drawing Figures

HEAT SET AND DESTRETCHED POLYESTER BACKING MATERIAL IN COATED ABRASIVE MANUFACTURE

This is a continuation, of copending application Ser. No. 654,328, filed Feb. 2, 1976 now abandoned.

BACKGROUND OF THE INVENTION

1. Field of the Invention

This invention relates to the heat setting and destretching of the woven polyester containing, fabric backing material used in a coated abrasive product, such as an endless belt. More particularly, this invention relates to a new and improved, heat set and destretched and cloth finished woven polyester containing, fabric backing material for a coated abrasive product, a new and improved coated abrasive product incorporating such cloth finished backing material, such as an endless belt, a new and improved method of such heat setting and destretching and cloth finishing, and a new and improved method of making such coated abrasive product incorporating such heat setting and destretching and cloth finishing method.

2. Prior Art

Heretofore, the accepted way of making a coated abrasive product, and especially an endless belt, involved primarily the use of a woven cotton fabric backing material, and to a lesser degree of woven viscose rayon fabric backing. In either case however, these backing materials inherently are limited in strength, toughness, body retention and base adhesion. Moreover, attempts to incorporate an all thermosetting resin system have resulted in unacceptable embrittlement of the fabric backing, especially cotton.

SUMMARY OF THE INVENTION

Accordingly, it is a primary objective of this invention to overcome these disadvantages of the prior art by the use of a heat set and destretched woven polyester containing backing material for a coated abrasive product, and thereby obtain a product which not only possesses greater strength, toughness, body retention, pliability and base adhesion properties, but also readily can be used in an all thermosetting resin system without undesirable embrittlement. To this end, the invention provides: (1) a new and improved, heat set and destretched and cloth finished, woven polyester containing fabric backing material for a coated abrasive product, and preferably a fabric woven from 100% high tenacity polyester staple fibers in a sateen weave; (2) a new and improved coated abrasive product incorporating such cloth finished backing material, and preferably in endless belt form; (3) a new and improved method of heat setting and destretching and cloth finishing such fabric backing material; and (4) a new and improved method of making such coated abrasive product and incorporating such heat setting and destretching and cloth finishing method.

A more specific objective is to provide such heat set and destretched backing material having: a dimensional stability warpwise of less than about 6.5% elongation at 170 pounds per linear inch of width tensile; and preferably a fabric cover of more than about 99%.

Another more specific objective is to provide such heat set and destretched backing material with a cloth finish including fill and front fill coats containing thermosetting resin, with such cloth finished backing material preferably having a dimensional stability warpwise which is increased over that of such backing material without such cloth finish; with such cloth finish preferably including back fill and back size coats containing thermosetting resin, preferably acrylic polymer, and a front fill coat containing thermosetting resin, preferably phenol formaldehyde resin, and such dimensional stability preferably being increased over that of such backing material without such cloth finish; or with such cloth finish preferably including dip fill and front fill coats containing thermosetting resin, preferably phenol formaldehyde resin, and such dimensional stability preferably being increased over that of such backing material without such cloth finish.

An additional more specific objective is to provide such coated abrasive product, preferably an endless belt, incorporating such cloth finished backing material and having successive maker, abrasive and size coats over the front fill coat, and as an alternative, a pre-size coat between such front fill and maker coats, for enhanced base adhesion, such maker and size coats, as well as such pre-size coat, if present, containing thermosetting resin, preferably phenol formaldehyde resin, with such coated abrasive product being cured, preferably product finished to form and endless belt and able to withstand being doubled upon itself across the warp, abrasive side compressed, without shattering, and without being torn readily across the wrap manually, in the crease produced during such doubling.

A further more specific objective is to provide such heat setting and destretching method comprising: maintaining such backing material under both wrapwise and weftwise tension, while heating to a temperature and for a time sufficient to provide such backing material with a dimensional stability wrapwise of less than about 6.5% elongation at 170 pounds per linear inch of width, while maintaining its desired width during such heat setting and destretching; with such warpwise and weftwise tension preferably being sufficient to increase the fabric cover from more than about 96% to more than about 99%; with such wrapwise tension preferably being sufficient to produce an average length increase of more than about 4% and such weftwise tension preferably being sufficient to limit the average width decrease to about 5%; with such temperature and time preferably ranging from about 400° to about 460° F. and from about 0.75 to about 2 minutes, and with such temperature more preferably being about 440° F. and such time more preferably ranging from about 1 to about 1.5 minutes.

Still another more specific objective is to provide such cloth finishing method including: providing such heat set and destretched backing material with a cloth finish including fill and front fill coats containing thermosetting resin, and wherein such cloth finished backing material preferably is provided with a dimensional stability warpwise which is increased over that of such backing material without such cloth finish; wherein such cloth finish preferably includes back fill and back size coats containing thermosetting resin, preferably acrylic polymer and a front fill coat containing thermosetting resin, preferably phenol formaldehyde resin, and such dimensional stability preferably is increased over that of such backing material without such cloth finish; or wherein such cloth finish preferably includes dip fill and front fill coats containing thermosetting resin, preferably phenol formaldehyde resin, and such dimensional stability preferably is increased over that of such backing material without such cloth finish.

Yet another more specific objective is to provide such method of making such coated abrasive product, preferably such endless belt, incorporating such heat setting and destretching and cloth finishing method and including coating such cloth finished backing material with successive maker, abrasive and size coats over such front fill coat, and as an alternative, applying a pre-size coat over such front fill coat before applying such maker coat, for enhanced base adhesion, such maker and size coats, as well as such pre-size coat, if present, containing thermosetting resin, preferably phenol formaldehyde resin, and curing such coated backing material to produce a coated abrasive product, and preferably product finishing such coated backing material to produce such endless belt, able to withstand being doubled upon itself across the warp, abrasive side compressed, without shattering, and without being torn readily across the warp manually, in the crease produced during such doubling.

Additional objectives and advantages of the invention will become evident upon consideration of the following detailed description and accompanying drawings.

DESCRIPTION OF THE PREFERRED EMBODIMENTS

GENERAL DESCRIPTION OF THE INVENTIVE BELT

Figure 1:
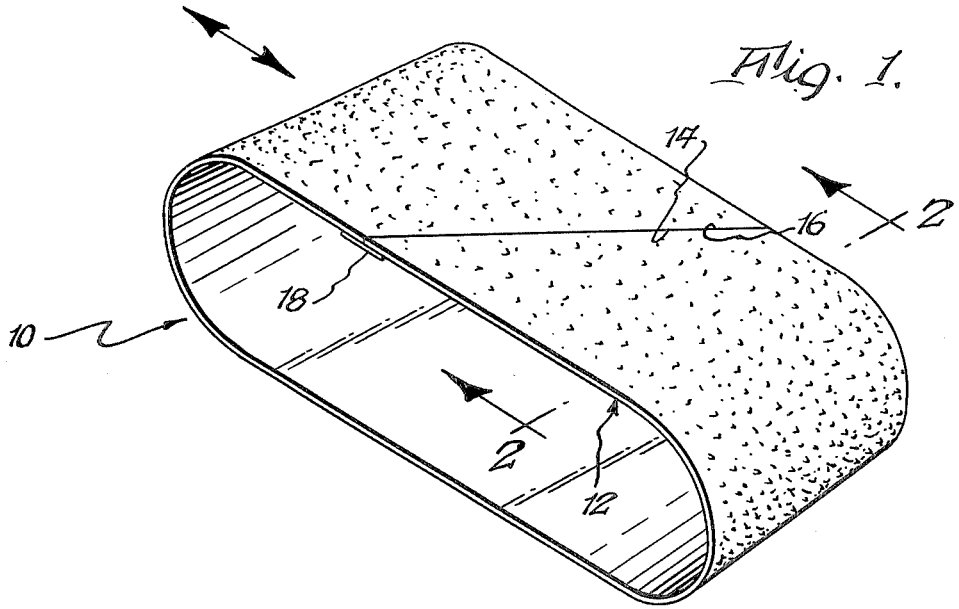
FIG. 1 is a perspective view of an endless coated abrasive belt constituting a preferred embodiment of the invention.

Referring to the drawings, and particularly FIG. 1, a preferred embodiment of the inventive coated abrasive belt is generally indicated at 10, and includes a composite or laminar sheet 12 which is turned upon itself, abrasive side outwardly, to arrange its opposite end portions 14, 16 in edge abutting relationship. As should be evident from FIG. 1, these end portions 14, 16 are slit at an angle to the running direction of the belt, as indicated by the arrows, and the desired butt joint is provided by a patch splice generally indicated at 18. This splice may be of any suitable construction, such as disclosed in U.S. Pat. Nos. 3,665,660 and 3,763,604.

Alternatively, the belt could be formed with a lap splice by skiving the end portions, interposing a suitable adhesive and then heat pressing the joint, as is well known in the art.

Figure 2:
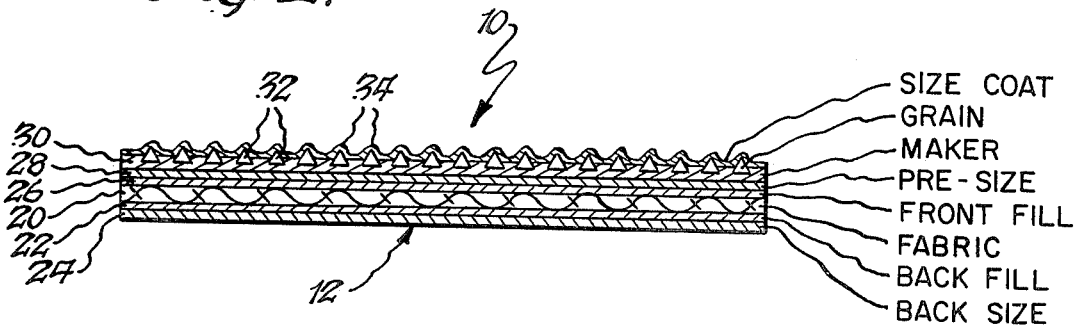
FIG. 2 is an enlarged vertical section taken generally along line 2—2 of FIG. 1, and illustrating the laminar construction thereof, with the various layers being disproportionately enlarged for clarity of illustration.

Turning now to FIG. 2, the cross-sectional, multilayer or laminar construction of the belt of FIG. 1 is illustrated in exaggerated form for clarity. In other words, the proportion of the thickness of the various layers is not to scale, but rather considerably enlarged in order to indicate the presence and nature of each layer and its relationship with the adjacent layers.

Thus, sheet 12 of belt 10 includes a woven fabric backing material 20, preferably of 100% polyester fabric woven from polyester staple fibers in a sateen weave. On the back or lower side of backing material 20, is a back fill coat 22 and on this coat is a back size coat 24. The manner in which these coats are applied will be described in detail below, but it is to be noted at this point that the back fill coat 22 actually impregnates the backing material 20.

On the top or front side of backing material 20 is a front fill coat 26, which also impregnates the fabric, and on top of this is arranged a pre-size coat 28, on top of which is located the maker coat 30. Embedded in the maker coat is a layer of abrasive grain 32, and this layer is, in turn, covered by a size coat 34.

Figure 3:
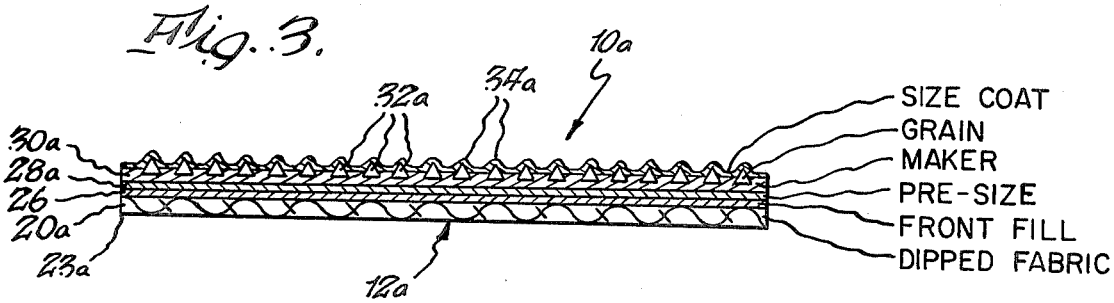
FIG. 3 is a view similar to FIG. 2, but illustrates the laminar cross-section of an alternative preferred embodiment of the inventive belt.

An alternative preferred embodiment of the inventive belt is illustrated in FIG. 3, which is similar to FIG. 2, and where the layers and coats are the same, the same numerals are employed, followed by the small letter "a". However, in the embodiment of FIG. 3, the back fill coat 22 and the back size coat 24 of FIG. 2 are replaced by dipping the fabric backing material **20*a* in an appropriate fluid composition to provide a dip fill envelope or coat 23*a* completely surrounding and impregnating both the back and front sides of backing layer 20*a*. Of course, as shown in FIG. 3, the backing material 20*a*** has been cut to the desired belt width; hence the envelope is removed from the side edges.

In each embodiment, as illustrated in FIGS. 2 and 3, however, a critical feature of the construction is the heat set and destretched condition of the backing material prior to the addition of the other layers, and prior to the cutting to belt width.

GENERAL DESCRIPTION OF THE METHOD OF MAKING THE INVENTIVE BELT

Continuing with FIGS. 1–3, the manufacturing procedure may be said to include 6 basic steps, as follows. In describing such procedure, it is to be noted that FIGS. 1–3 show the finished product cut to width, whereas prior to belt formation, the various layers and/or coats are considerably wider, depending upon the width of the woven fabric material roll provided.

The first step is weaving the wide fabric backing material from which the narrow backing material 20 or **20*a* is formed. The second step is heat setting and destretching such fabric backing material, as will be described in detail below, and with particular reference to FIGS. 4–7. The third step is that of cloth finishing, and this includes the application of the back fill coat 22, back size coat 24 and front fill coat 26 of FIG. 2. The same is true for the embodiment of FIG. 3, except that the back fill coat 22 and the back size coat 24 are replaced by the dip coat or envelope 23*a***.

As an alternative procedure, and as preferred for heavy duty, non-waterproof type belts, such as those illustrated in FIGS. 2 and 3, it is both necessary and desirable to include a pre-size coat 28 (FIG. 2) or **28*a* (FIG. 3**), in order to enhance the base adhesion properties of the finished product.

The fourth basic step in such belt manufacture is generally referred to as coating, and this includes the steps of applying the maker coat, the grain layer and the size coat, as illustrated in FIGS. 2 and 3.

The fifth basic step or procedure in such belt manufacture is that of curing, which will be explained in more detail below, and involves the heat treating of the coated roll of backing material from which the belt is made.

The sixth and final procedure involves that which is generally referred to as product finishing, and this includes the flexing, and slitting of the roll cured belt matrix into the various desired belt widths, bias cutting and positioning the abutting end portions 14, 16, such as shown in FIG. 1, and applying the splice, such as 18, to complete each individual belt.

GENERAL DESCRIPTION OF HEAT SETTING APPARATUS EMPLOYED IN THE INVENTIVE METHOD

Figure 4:
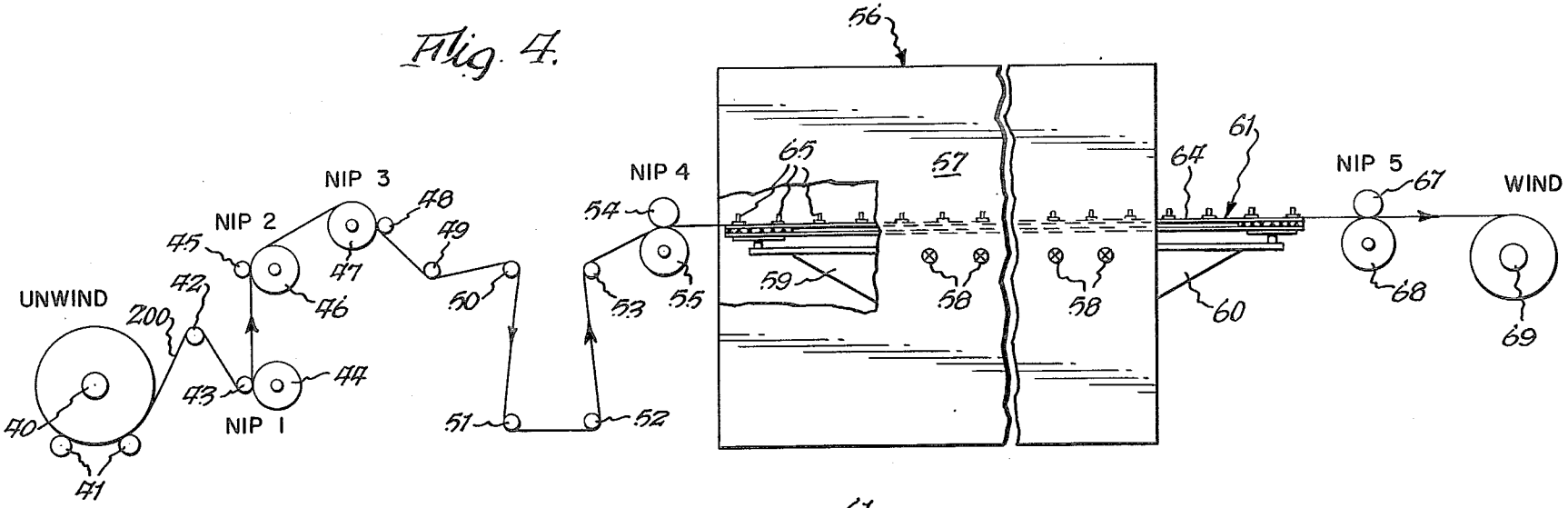
FIG. 4 is a schematic side elevation of a preferred apparatus employed in practicing the inventive method of heat setting the inventive backing material.
Figure 5:
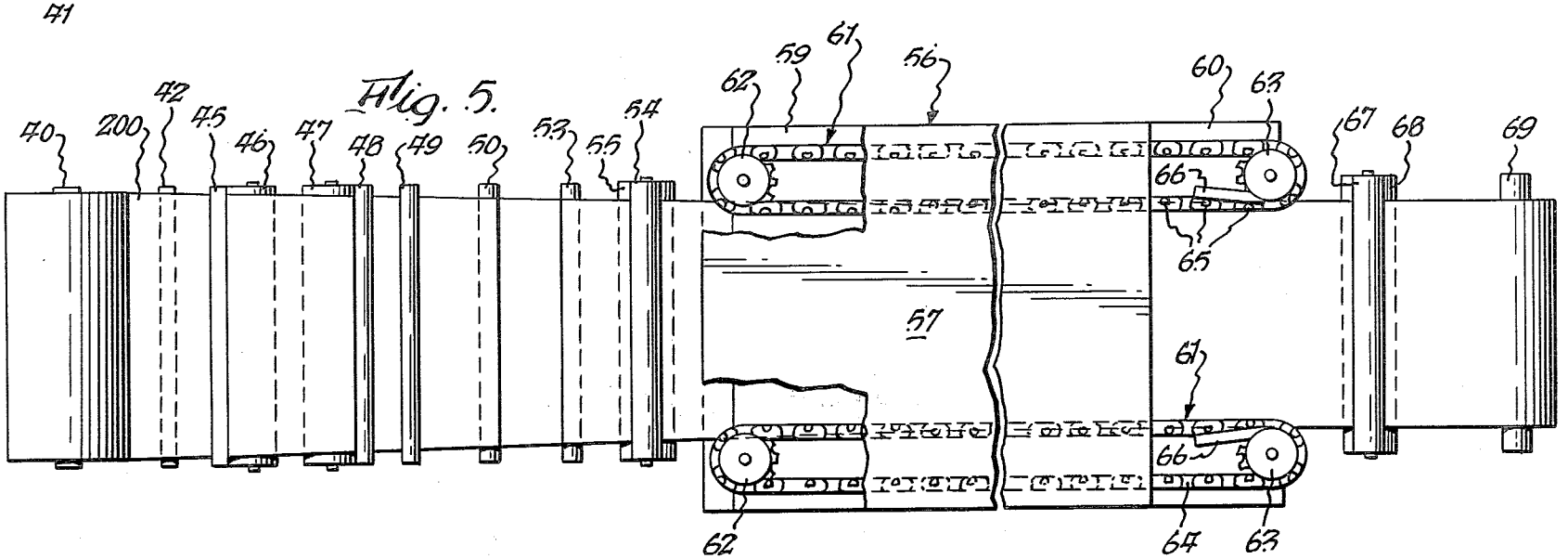
FIG. 5 is a top plan view of the apparatus of FIG. 3.

Referring now to FIGS. 4 and 5, there is shown in schematic outline form such heat setting apparatus which actually was used in heat setting the backing material referred to in each of Examples 1 and 2.

This apparatus includes a supply or unwind roll 40, on which the roll of fabric 200, for making up the narrower backing material 20 (FIG. 2) or 20*a* (FIG. 3), is supplied. As the wide backing material 200 is fed from left to right; it proceeds from supply roll 40 over support rolls 41, whereupon it is taken off over guide roll 42, and is then passed through nip rolls 43, 44, which are designated as the "NIP 1" position. From here, the backing 20 is fed between nip rolls 45, 46, which constitute the "NIP 2" position, and then proceeds between nip rolls 47, 48, forming the "NIP 3" position, under guide roll 49, over guide roll 50, down under guide rolls 51, 52 and up over guide roll 53 to nip rolls 54, 55, which constitute the "NIP 4" position. It is to be noted at this point that these nip rolls 54, 55 are driven at variable speed which is greater than the speed at "NIP 3" position to apply wrap tension, but which was less than the tension speed of the chain and clip assemblies described below, (also known as the tenter frame), in order to put additional warp tension on the fabric while it is being heated.

Next, the material passes through the combined heat treating and destretching apparatus generally indicated at 56. This apparatus is known as a clip tenter and includes an oven generally indicated at 57 and provided with a number of stations or controls 58 for adjusting and setting the width of the tenter frame. By means of a support structure which is cantilevered at each end, as shown at 59 and 60, such apparatus includes the dual chain and clip mechanisms or assemblies generally indicated at 61, and having a common drive (not shown), for feeding material 200 through oven 57 while maintaining the desired width thereof. To this end, each such assembly or mechanism 61 includes, at the entrance end of the oven a sprocket 62 and at the exit end of the oven another sprocket 63, with the two being connected by a link type chain 64 on which are mounted a series of clip mechanisms 65. The detailed structure of this assembly is disclosed in U.S. Pat. Nos. 3,180,0001 and 3,234,622, which are incorporated herein by reference.

Generally speaking, the clip mechanisms 65 are disengaged on the outer reach of chain 64 and become engaged with the fabric 200 on the inner reaches of the chain in order to maintain the desired width of the material during heat setting and destretching thereof. To facilitate disengagement of the clips with the fabric, the dual assemblies are provided with guides 66 at the exit end of the oven, and which guides are designed to actuate the clips so as to disengage the same from the fabric, in order to facilitate even and uniform passage of the fabric between nip rolls 67, 68 as the fabric leaves oven 57. These nip rolls constitute "NIP 5" position and are driven at variable speed (set at about the same as assemblies 61) to insure proper declipping of the fabric in its running or wrap direction as it passes through the heat setting and destretching apparatus, because the wind up roll drive is not adequate for this purpose. Finally, the heat set and destretched fabric is wound on wind up roll 69 for further processing.

ALTERNATIVE PREFERRED EMBODIMENT

In addition to the heat setting apparatus employed in FIGS. 4 and 5, that illustrated schematically in FIGS. 6 and 7 also has been used to successfully heat set the fabric in practicing the inventive method, particularly as set forth in Examples 3–5 below.

Thus, only the differences in the two types of apparatus will be described, with the same numerals being used in FIGS. 6 and 7 as for FIGS. 4 and 5 to designate like parts, with the addition of the small letter "a".

Figure 6:
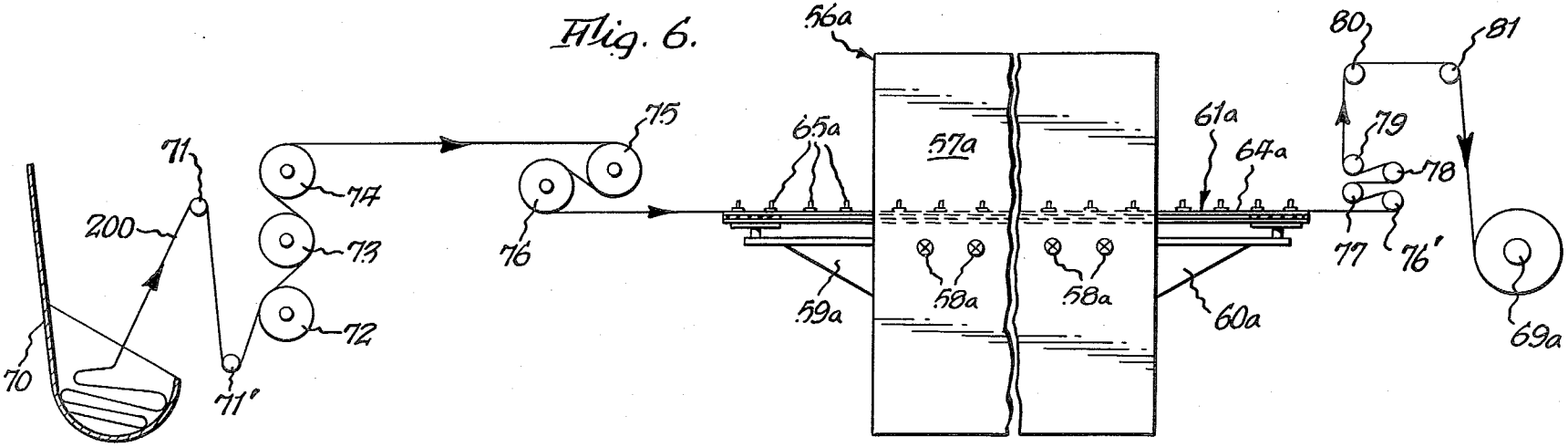
FIG. 6 is a schematic side elevational view similar to FIG. 4, but illustrating an alternative preferred apparatus employed in the inventive method of heat setting the inventive backing material.
Figure 7:
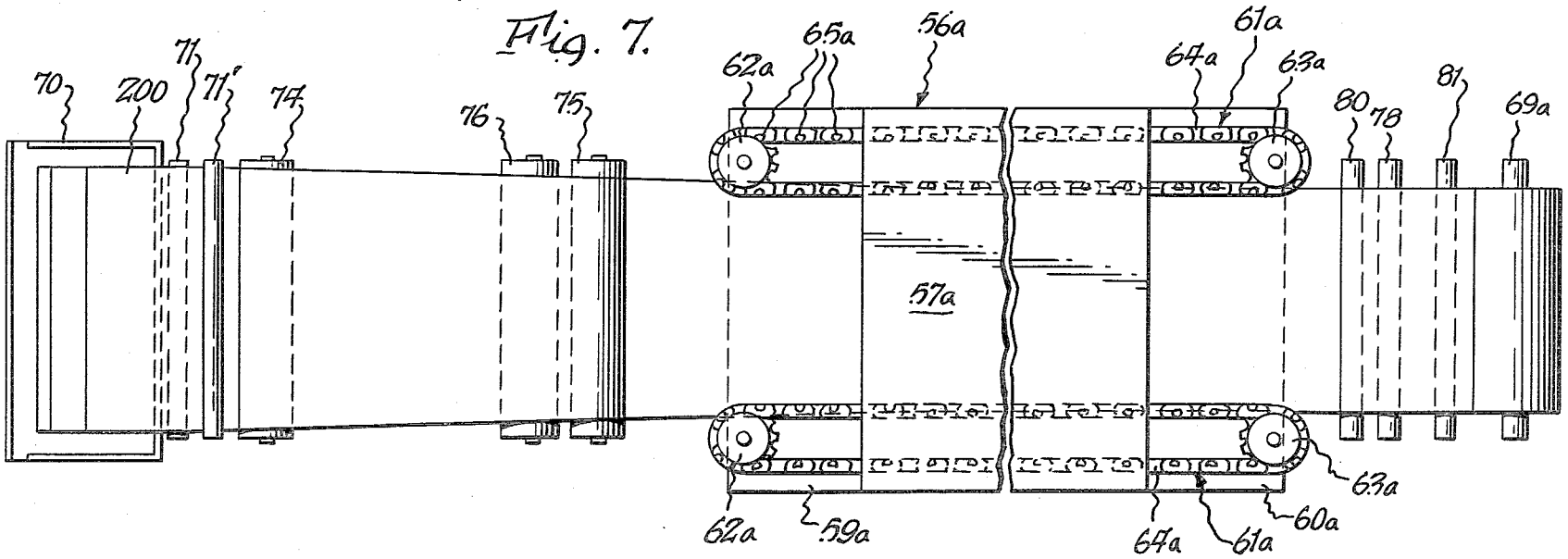
FIG. 7 is a top plan view of the apparatus of FIG. 6.

Referring to FIGS. 6 and 7, instead of a supply roll, the fabric 200 may be heat set from a trough 70 or the like, whereupon it is passed over a guide roller 71 and under another guide roller 72 prior to passing through the three high vertical stand of squeeze rollers 72, 73 and 74, which replace "NIP 1", "NIP 2" and "NIP 3" positions of FIG. 4. Next, the fabric travels around knurled rollers 75, 76, which have a variable speed drive, prior to entering oven 57*a* of heat setting apparatus 56*a* and engagement with the dual chain and clip assemblies 61*a*. The only differences between these last mentioned parts and those correspondingly numbered parts in FIGS. 4 and 5 is the exposure of the support structure at the entrance to the oven 57*a*, and the elimination of the guides or wings 66*a*, which have been found not to be necessary with this particular apparatus. Otherwise, the structure and operation of the oven and chain and clip assemblies are just as described above.

Following heat setting and destretching, the fabric is passed over the spaced ganged rolls 76, 77, 78 and 79, which replace the nip rolls 67, 68 at "NIP 5" position of FIG. 4. Whereupon, the fabric passes over guide rolls 80 and 81 to the wind up roll 69*a*.

DETAILED DESCRIPTION OF INVENTIVE METHOD AND PRODUCT

EXAMPLE 1

A 100% polyester sateen fabric was woven on a standard loom using a high tenacity polyester fiber designated as Eastman-Kodel 421. This fiber is believed to be thermoplastic, and has the characteristic of high tenacity, superior strength, high modulus and relatively low elongation. It also has the following properties: Tenacity, 6 g/den; Elongation, 24%; Tenacity at 10% Elongation, 4.5 g/den; Initial Modulus, 55 g/den; Average Toughness, 0.90 g/den; Specific Gravity, 1.38; Moisture Regain, 0.4% at 65% RH, 70° F. (21° C.); Cross Section, Round; Yarn Shrinkage, in hot water at the boil, 2 minutes, 2%, and in hot oven at 374° F. (190° C.), 10 minutes, 11%. Tensile properties were measured on single filaments with an Instron Tensile Tester operated at 70° F., 65% relative humidity.

The above information was obtained from Publication No. TDS K-103a-III, Fifth Edition 1972 by Eastman Chemical Products, Inc., Kingsport, Tennessee, and such publication is incorporated herein by reference.

The fabric was a 5 harness, 4/1 sateen construction using such 2 denier, industrial grade, high tenacity, polyester staple fiber. The fabric was woven with 96 warp yarns, 13/1, and 42 filling yarns 23/1, at a nominal weight of 1.42 yards per pound and a width of 60 inches. This construction produced a fabric weight of 6.76 ounces per square yard and a woven fabric cover of 96.63%. The calculation for fabric weight is 1 pound×16 ounces per pound×36 inches per yard/1.42 yards×60 inches. The well-known Golec formula for fabric cover, as set forth in U.S. Pat. No. 3,787,273, is the difference between 100 percent and the percent of air space, assuming regular twist yarns and maximum diameter per inch=28 $\sqrt{N}$, where N=yarn number. Thus, warp cover=warp ends per inch/28 $\sqrt{N_1}$; fill cover=fill picksper inch/28 $\sqrt{N_2}$; the open area (fabric air space)=(1-warp cover) (1-fill cover), and the % fabric cover =(1-the open area) 100. Accordingly, for this fabric, warp cover=96/28 $\sqrt{13}$=0.9509; fill cover=42/28 $\sqrt{23}$=0.313; air space=(1-0.9509)×(1-0.313)=0.0491×0.687=0.0337, and the % fabric cover=(1-0.0337) 100=96.63%. This woven substrate was subsequently heat set and destretched in the apparatus shown in FIGS. 4 and 5, to impart the required dimensional stability in the running or warp direction of the material of less than 6.5% elongation at 170 pounds per linear inch (pli) of width tensile using a standard ravel strip method of testing. Briefly, this testing method involved cutting a 1¼ inch wide heat set sample to a warp length of 10 inches, with the outer warp yarns being raveled out to leave a 1 inch width. The sample was placed in an Instron Tensile Tester with the jaws set at a 5 inch gap using 3 inch and 2 inch face clamps. The jaws and chart were set at speeds of 2 inches/min. and 0.5 inch/min. respectively, in order to determine the elongation at 100 and 170 pli, and the warp tensile strength at break pli.

The heat setting was attained by using the standard drying tenter apparatus of FIGS. 4 and 5, and which had a heating capacity of 500° F. This apparatus is manufactured by Marshall & Williams Corporation, Providence, Rhode Island. The entrance to the oven is constructed so that the fabric was nipped at the "NIP 4" position (FIG. 4), thereby causing the longitudinal tension, inasmuch as the tenter frame (chain and clip assemblies 61) was set to travel faster than the variable speed drive nip rolls 54, 55.

Referring to FIGS. 4 and 5 in particular, a 60 inch wide roll of the fabric was placed upon unwind roll 40, and then fed through the machine to, but not into oven 57. The oven then was heated to 440° F. while the tenter frame (forming the dual chain and clip assemblies 61) was set at a width of 56 inches. The entrance of the tenter frame is so designed that it is self-adjusting as to the width of the entering cloth fabric.

Following this, the fabric 200 was fed through the entire length of machine 56 and rolls 67, 68 were closed at "NIP 5" position. Once the fabric has passed through this position, it then was wound on wind up roll 69. Next, the surface speed of rolls 54 and 55 was set at 16 surface feet per minute, while the exit speed of rolls 67, 68 as set at 21 surface feet per minute (the speed of chain sprockets 62, 63 being measured at 21.5 surface feet per minute). Finally, nip rolls 45, 46 and 47, 48, were closed at the "NIP 2" and "NIP 3" positions respectively.

Fifteen rolls (approximately 200 yards per roll) of fabric 200 were heat set and destretched successfully to an elongation of less than 6% at 170 pli (ravel strip test). The backing material was heated to about 440° F. for about 1 minute, because the oven was only about 25 feet long. In addition, markers, to determine width decrease, as well as length increase, were sewn into the fabric with the following results. The weftwise tension was sufficient to limit the average width decrease from the woven state through heat setting and stabilizing to 5%. The warpwise tension was sufficient to produce average length increase of 4.3%. Hence, the warpwise and weftwise tension were sufficient to increase the fabric cover to 99.86%. This figure was determined from the foregoing formula after adjusting for the changes in ends and picks per inch caused by the average width decrease and length increase. Thus, 1.05×96=100.8 warp ends per inch; warp cover=100.8/28 $\sqrt{13}$=0.998, and warp air space=1.000−0.998=0.002; likewise 0.957×42=40.194 fill picks per inch; fill cover=40.194/28$\sqrt{23}$=0.299; fill air space=1.000−0.299=0.701; fabric air space=0.002×0.701=0.0014=0.14%, and fabric cover=100−0.14=99.86%.

In order to compare the pertinent physical properties with a standard belt backing construction made of cotton, the following control was treated in the same manner as noted above. This control construction was a comparable roll of cotton drill, woven with 76 ends and 48 picks, $12\frac{1}{2}^s$ warp and $17^s$ fill. This construction was subjected to a standard wash and dye process and dried in the normal way, producing a 4.8% width decrease.

The pertinent physical properties of each type of fabric are set forth below.

TABLE I

| | Tensile pli Warp | % Elongation at 170 pli Warp | % Elongation at 100 pli Warp |
|---|---|---|---|
| Polyester HS | 346 | 5.9 | 2.3 |
| Cotton Standard Wash and Dye | 135 | — | 6.9 |

NOTE: Elongations at 170 pounds per inch were not compared because the cotton ruptured at less than 170 pounds per inch. However, one readily can see from the above TABLE that both the strength and the elongation characteristics of the inventive heat set polyester fabric were substantially superior to the cotton control fabric.

The polyester fabric 200 was subsequently cloth finished, as was the cotton control fabric, using a back fill and back size of AC 604/$CaCO_3$ and a front fill of phenolic/$CaCO_3$ of the following formulations.

BACK FILL AND BACK SIZE FORMULATION

| | Wet Lbs. | Dry Lbs. | % Dry Basis |
|---|---|---|---|
| AC 604 | 475.0 | 218.5 | 48.86 |
| $CaCO_3$ | 218.0 | 218.0 | 48.74 |
| $NH_4SCN$ | 4.5 | 4.5 | 1.01 |
| Tamol 731 (25%) | 2.5 | 0.63 | 1.14 |
| CMC (8%) | 70.0 | 5.60 | 1.25 |
| Water | 66.6 | — | — |
| TOTAL | 836.6 | 447.23 | 100.00 |

NOTE:
The viscosity of the formulation, at 75° F. was 5,500 cps ± 500 cps, and the solids content was 53%.

Rhoplex AC 604 is a thermosetting acrylic emulsion polymer supplied by Rohm & Haas Company, Independence Mall, West, Philadelphia, Pa. 19105, and had a brookfield viscosity at 25° C. of 20–100 cps, a solids content of 46% and a pH of 9.5–10.5. This resin is described in the Rohm & Haas Technical Bulletin C-340, February, 1972, and this Bulletin is incorporated herein by reference. The ammonium thiocynate crystals were used for catalysis of the AC 604 and were purchased from McKesson Chemical Company, 803 Walden AVenue, Buffalo, N.Y. The Tamol 731 (25% solids) was a dispersing agent also available from Rohm & Haas Company. The calcium carbonate (ground limestone) had a $CO_2$ content of 43.88±0.43%, a specific gravity of about 2.74, an average particle size between 17 and 25 microns, as measured at the 50% point on a sedimentation curve, a white color, a particle size range such that not more than 35% by weight remained on a 220 mesh screen having an opening of 53 microns (USS), and freedom from organic impurities and inorganic trace elements such as $SiO_2$, $Fe_2O_3$, $Al_2O_3$, and clays. The vendor is National Gypsum Company, Philadelphia, Pa.

The sodium carboxymethyl cellulose was an anionic, water soluble thickening agent, having a pH of 7.0 at 2% solution, a solids content of 95±1%, and a viscosity of 25–30 cps, number 1 spindle at 60 rpm, using a Brookfield LVF viscometer.

The back fill and back size is a 1:1 ratio of AC 604/$CaCO_3$ on a dry basis composition. The system is catalyzed with ammonium thiocynate in a 1:48 ratio based on dry AC 604. The wetting agent (Tamol 731), thickener (8% carboxymethyl cellulose), brown pigment and water are added to obtain a viscosity of 5,500 cps±500 cps at a temperature of 75° F. The total solids of the solution is 53% dry basis.

The viscosity will vary with the coating application method used, as is known by those skilled in the art. The knife on web system actually used requires a viscosity of 5,500 cps in order to produce a satisfactory finish. However, if a flexible knife on roll method of application is employed (or an inverted knife as well), the viscosity can be dropped as low as 1,300 cps to obtain a satisfactory finish.

The back fill deposition is 3.5±0.5 dry pounds per ream (1 ream equals 480 9×11 sheets). The back size composition, which is the same as the back fill, was deposited dry at 2.5±0.5 pounds per ream. As noted above, the viscosity will vary depending upon the method of application, i.e., knife or roll.

The front fill composition employed was a 1:1 ratio of a phenol formaldehyde resole and calcium carbonate on a dry basis. The viscosity was 1,300 cps±150 cps at 90° F., with a solids content of 75%, by weight, dry basis. This composition had the following formulation.

| FRONT FILL FORMULATION | Wet Lbs. | Dry Lbs. | % |
|---|---|---|---|
| P-F1 resin | 500 | 345 | 50.70 |
| $CaCO_3$ | 333 | 333 | 48.93 |
| Span 20 | 2.5 | 2.5 | 0.37 |
| Furfural | 67.9 | — | — |
| TOTAL | 903.4 | 680.5 | 100.00 |

The P-F1 resin had a formaldehyde/phenol ratio of 0.99, and contained ethylene diamene as the catalyst constituting 0.6% of the total charge. This catalyst was modified with furfural and shelacol constituting 4.6% and 2.0% respectively of the total charge. The physical properties of the resin were: pH=7.7±0.2, specific gravity=1.120±0.025, solids content=69±3%, viscosity=1,400 cps∓200 cps, and G. E. Gel time at 121 C=20±2 minutes.

The $CaCO_3$ was the same as noted above. Span 20 is a sorbitan monolaurate, used as a wetting agent and is available from McKesson Chemical Company, Buffalo, N.Y.

The furfural (furfuryl aldehyde) is a solvent thinner with a specific gravity of 1.165±0.005 at 20/20° C. This material may be obtained from Quaker Oats Company, Cleveland, Ohio.

The viscosity and solids may vary according to the method of deposition, as known to those skilled in the art, with the roll coating actually used requiring considerably less viscosity than if a knife coating were employed. For coarse grits, a roll coating does produce a satisfactory deposition, but for fine grit products, it may be necessary to knife coat such face or front fill composition.

The deposition used to achieve the satisfactory product was 8±2 pounds per ream of face or front fill.

As noted above, the heat set inventive polyester woven fabric and the cotton control fabric were cloth finished using the foregoing teachings. It also is to be noted that an attempt was made to cloth finish non-heat set and destretched polyester fabric, but this was found to be impossible because of curling (tubing), i.e., rolling up of the selvage edges of the fabric toward the center of the fabric. Hence, further efforts along this line were discontinued.

For the non-waterproof coated abrasive product produced in accordance with this Example, the polyester and cotton constructions were as follows:

| | POLYESTER | COTTON |
|---|---|---|
| Backing Material (as woven) | 96 × 42 sateen | 76 × 48 drills (Standard in the Coated Abrasive Industry) |
| Backing weight | 17.0 ± 0.7 lbs/ream | 15.7 ± 0.7 lbs/ream |
| Heat set and Destretched | Yes | Pull Down Only |
| Back fill - AC 604/$CaCO_3$ | 3.5 ± 5 lbs/ream | 2.1 lbs/ream |
| Back size - AC 604/$CaCO_3$ | 2.5 ± 0.5 lbs/ream | 2.1 lbs/ream |
| Front fill - P-F Resole $C_aCo_3$ | 7.0 ± 0.5 lbs/ream | 7.2 lbs/ream |

NOTE:
Everything else being the same, it was found to be impossible to deposit the same amount of back fill and back size on the cotton substrate as on the polyester, although the front fill met the specifications.

A comparison of the properties of these filled fabrics is set forth below.

TABLE II

| | POLYESTER (Heat set and Destretched) | COTTON (Pull Down) only) |
|---|---|---|
| Warp Tensile: Pli | 472 | 254 |
| % Elongation at 170 pli | 4.8 | 2.4 |
| Elmendorf tear: Cross-warp | Warp did not tear (propagated across fill | 693 |
| Base Adhesion: | | |

TABLE II-continued

| | POLYESTER (Heat set and Destretched) | COTTON (Pull Down) only) |
|---|---|---|
| Instron Pli | 17.8 | Embrittled |

NOTE:
No further work was done with the cotton because of embrittlement.

In preparing for the base adhesion test, the specific maker mix described below was applied to the face side of an 8 inch×10½ inch sample of each fabric with roll bars. This was repeated and a sandwich was made of the two samples. The sandwich was pressed through a laboratory padder for uniform contact. Following drying for 3 hours at 200° F., with a disc weight on top, the samples were stapled on three of the four sides, leaving one side to begin peeling. The samples then were cured for a time of about 16 hours at a temperature of about 225° F.

The cured samples were cut into one inch wide strips about 10½ inches long in the machine direction using a cutting board and a one inch placement control on the Instron Tensile Tester. Next, the samples were peeled by hand until the peeled strips extended past the opposite end of each sample. A one inch strip was placed on a steel bar and clamped with the bar into the upper jaw of the Instron. The remaining peeled strip was placed in the lower jaw, thus causing 180° peel. The jaws were secured shut and the Instron was run at a speed of 0.5 inches per minute. The speed was charted; the 0.5 inch per minute cross-head speed and the pound scale were also charted.

From the foregoing Table it is evident that the excellent tensile, acceptable elongation and excellent tear properties across the warp, and the fact that the polyester was not embrittled during the adhesion test, show substantial superiority of the inventive polyester fabric over that of the standard cotton control substrate.

PRE-SIZE

Continuing with the inventive method, and as noted previously, a pre-size may be applied to enhance adhesion. This alternative step occurs prior to deposition of the maker coating. In the manufacture of the belts illustrated in FIGS. 2 and 3, a pre-size was used and is denoted at 28 and 28*a* respectively.

The undiluted pre-size composition is a water soluble phenolic resin having a formaldehyde/phenol ratio of 1.01, and a 50% sodium hydroxide catalyst constituting 0.6% of the total charge. The properties are: pH=7.85±0.15; S.G.=1.195±0.015, solids=70%±3%; viscosity=500 cps±150 cps, gel at 121° C. in 28±3 minutes.

This pre-size layer was applied by means of a two roll padder to a deposition weight of 4 pounds per ream, wet basis. The pre-size is subsequently dried to a tack free state.

MAKING COAT

The maker solution was made up of the same resin system as the pre-size solution, but with the incorporation of $CaCO_3$ and Span 20 for wetting. Thus, the composition has the following formulation.

| | MAKER FORMULATION | | |
|---|---|---|---|
| | WET | DRY | % |
| Pre-size resin | 550 | 385 | 41.04 |
| $CaCO_3$ | 550 | 550 | 58.64 |
| Span 20 | 3 | 3 | 0.32 |
| TOTAL | 1,103 | 938 | 100.00 |

NOTE:
Total solids content was 85.04% by weight, dry basis.

This maker system was roll coated to a deposition weight of 21 pounds per ream on a wet basis, and such maker coat is illustrated in FIGS. 2 and 3 at 30 and 30*a* respectively.

GRAIN DEPOSITION

The belt matrix at this point was inverted so that the maker coat faced downwardly, whereupon grit 36 aluminum oxide grain was then propelled upwardly electrostatically and embedded in the fluid mass at about 62 pounds per ream. Following this, the grain coated article was subsequently dried to a tack free state, so that the embedded grit did not lose its orientation.

SIZE COATING

Following curing the maker, the article was then coated with a size or sand size coat having the following composition.

| | SIZE COAT | | |
|---|---|---|---|
| | WET | DRY | % |
| Pre-size resin | 550 | 385.00 | 40.45 |
| Cryolite | 550 | 550.00 | 57.79 |
| Span 20 | 3.75 | 3.75 | 0.39 |
| Tamol 731 (25%) | 8 | 2.00 | 0.21 |
| Nalco 123 | *2.00 | — | — |
| Attagel 50 | 11.00 | 11.00 | 1.16 |
| TOTAL | 1,124.75 | 951.75 | 100.00 |

*Approximate, assumed to contain no solids.

The pre-size resin is described above. The synthetic cryolite had the following formulation.

| INGREDIENTS | % BY WEIGHT, DRY BASIS |
|---|---|
| Cryolite ($Na_3AlF_6$) | 91.0–94.0 |
| F | 48.0–52.0 |
| Al | 13.0–15.0 |
| $Al_2O_3$ | 2.0–6.0 |
| Si | 0.14–0.30 |
| $CaF_2$ | 0.04–0.09 |
| $Fe_2O_3$ | 0.01–0.10 |
| Free Moisture | 0.05–0.12 |
| SIEVE ANALYSIS | |
| 100 Mesh | 0.1% maximum |
| Thru 100, on 200 Mesh | 1.0% maximum |
| Thru 200, on 325 Mesh | 5.0% maximum |
| Thru 325 Mesh | 95% maximum |

NOTE:
The maximum pH value is 8.5, and this material may be purchased from Great Lakes Foundry Sand Company, Detroit, Michigan.

The descriptions of the Tamol 731 and Span 20 have been given previously.

Nalco 123 is an anti-foaming agent for both defoaming and preventing foam build-up in resin filler mixes. It is a blend of synthetic organic chemicals and can be purchased from Nalco Chemical Company, Chesterland, Ohio. Attagel 50 is a thickener for resin systems. It is an especially processed form of the mineral Attapulgite, an acicular-shaped magnesium aluminum silicate. It can be purchased from Meyers Chemicals, Inc., Buffalo, N.Y.

This size or sand size coat was applied by means of a roll system to a deposition weight of 29 pounds per ream, wet basis. The product then was roll cured.

PRODUCT FINISHING

At this point in the inventive process, the coated belt forming matrix was finished, wherein the matrix was slit to the desired width and length of the desired number of belts, which then were spliced to produce a belt having the general appearance shown in FIG. 1. During this finishing, it usually is necessary to flex the belt matrix prior to the splicing and slitting operations to facilitate handling.

STANDARD COMPARISON OR CONTROL PRODUCTS

In order to properly evaluate the performance of the belts made in accordance with the present invention, they were tested against two standard belts incorporating cotton backing material and constructed as follows.

COTTON CONTROL 1

The greige cloth construction of the Cotton Control No. 1, was a cotton drill, 76 ends by 48 picks, $12\frac{1}{2}^s$ warp and $17^s$ fill. The width decreased 4.8% prior to back filling, after the drying procedure of the standard wash and dye process.

The cloth was subsequently back-filled employing a two roll padder with a solution having the following formulation.

| | WET POUNDS | DRY POUNDS | % |
|---|---|---|---|
| Glue | 300 | 300 | 50 |
| Starch | 300 | 300 | 50 |
| Water | 833 | — | — |
| Steam | 92 | — | — |
| TOTAL | 1,525 | 600 | 100 |

NOTE:
Viscosity was 10,000 cps ± 1,000 cps at 150° F. The deposition was 4.0 ± 0.5 pounds per ream.

The glue properties were: viscosity, 58 mP±3 mP's; gel, 135 grams±5 grams; moisture, 12%±1.5%; pH, 6.5±1.0; ASA, 5% maximum; grease, 2.5% maximum; foam, 20 seconds; grading—at least 50% must be coarser than U.S. Standard 20 mesh, with no more than 2% passing 100 mesh and not more than 1% on the 6 mesh. The vendor is Peter Cooper Glue Company, Gowanda, N.Y.

The starch is a 50 fluidity thin boiling starch. It may be purchased from Hubbinger Company, Keouku, Iowa under the mark Reofilm 50.

The face fill and back size were applied by means of a two roll padder using a 25% glue solution having a viscosity of 40±5 cps at 150° F. The solution had the following formulation.

| | WET |
|---|---|
| Glue | 400 |
| Water | 1,216 |
| TOTAL | 1,616 |

NOTE:
Total solids were 25%.

The face fill deposition was 1.3±0.5 pounds per ream and the back size deposition was 1.0±0.5 pounds per ream. The glue was the same as that used in the back fill.

The backing was pre-sized with the P-F resole resin as previously described, with a deposition of 4.0 pounds per ream (wet).

The maker was then applied with a two roll padder to a wet deposition of 28 pounds per ream.

The maker formulation was as follows:

| | WET | DRY | % |
|---|---|---|---|
| P-F2 resin | 275.0 | 176 | 18.57 |
| P-F3 resin | 275.0 | 213 | 22.48 |
| $CaCO_3$ | 550.0 | 550 | 58.04 |
| Potassium Tripolyphosphate | 5.5 | 5.5 | 0.58 |
| Span 20 | 3.0 | 3.0 | 0.32 |
| TOTAL | 1,108.5 | 947.5 | 100.00 |

NOTE:
Total solids were 85.5%.

The P-F2 resin had a formaldehyde/phenol ratio of 1.76, with barium octahydrate catalyst constituting 2.24% of the total charge, and the properties were: pH=7.9±0.2; specific gravity=1.21±0.02; solids=64.0±2; viscosity=130 cps±35; water tolerance=100% minimum, G.E. gel at 121° C.=12±1.5 minutes.

The P-F3 resin had a formaldehyde/phenol ratio of 1.82, with barium octahydrate catalyst constituting 2.24% of the total charge, and the properties were: pH=8.0±0.1; specific gravity=1.275±0.015; solids content=77.5±2.5%; viscosity=3,500 cps±1,000 cps; water tolerance=75% minimum; G.E. gel at 121° C.32 9 minutes±2 minutes.

The potassium tripolyphosphate (a dispersing agent) was a clear and colorless solution, and it may be purchased from Chemical Sales, Buffalo, N.Y.

The aluminum oxide grit was deposited in the same way as previously described on the maker coat.

The grain so embedded was subsequently size coated, using a two roll padder applying a size coat having the following composition:

| | WET | DRY | % |
|---|---|---|---|
| P-F2 resin | 550 | 352 | 34.78 |
| $CaCO_3$ | 650 | 650 | 64.23 |
| Tamol 371 | 10 | 10 | 0.99 |
| Nalco | Trace | — | — |
| TOTAL | 1,210 | 1,012 | 100.00 |

NOTE:
Total solids content was 84%.

The same procedures followed previously were then followed with respect to the curing and product finishing operations.

COTTON CONTROL 2

The cloth substrate for this cotton control product was the same as for Cotton Control 1, including the cloth finishing, except for the pre-size, which had the following composition.

| PRE-SIZE FORMULATION | |
|---|---|
| | WET BASIS |
| Pre-size resin | 60% |

-continued

| PRE-SIZE FORMULATION | |
|---|---|
| | WET BASIS |
| Camelcarb ($CaCO_3$) | 40% |

This pre-size was supplied by means of a two roll coater to a deposition weight of 5.25 pounds per ream, wet basis. The pre-size resin is that described above. The Camelcarb is a fine grain $CaCO_3$. The $CO_2$ content is in excess of 40%, and the $CaCO_3$ content is in excess of 92%. The color is white; 99.5% by weight must pass through a 325 mesh screen (U.S.S.) and 70% must be finer than 15 microns. The vendor is S. A. Campbell and Co., Inc., Cleveland, Ohio.

The maker composition was the same as for the inventive product above, and was applied by rolls to a deposition weight of 21 pounds per ream, wet basis.

The size composition had the following formulation.

| | WET | DRY | % |
|---|---|---|---|
| P-F4 resin | 550.0 | 385 | 40.94 |
| Cryolite | 550.0 | 550 | 58.48 |
| Tamol 731 | 5.5 | 5.5 | 0.58 |
| Nalco | Trace | — | — |
| TOTAL | 1,105.5 | 940.5 | 100.00 |

NOTE:
The total solids were 85%. The cryolite, Tamol 731 and Nalco have been described above. The P-F4 resin had a formaldehyde/phenol ratio of 2.03 and contained 50% sodium hydroxide catalyst making up 1.5% of the total charge. The physicals were: viscosity, 350 ± 100 cps at 25° C., solids content, 70 ± 3%; G. E. Gel at 121° C., 11 ± 2 minutes; water tolerance, 500% minimum; pH, 8 ± 0.2; specific gravity, 1.195 ± 0.15. This size coating was roll coated to a deposition weight of 19 pounds per ream, wet basis.

COMPARISON TESTS

The inventive polyester backed belt product then was tested as were the two standard products containing cotton backing. The belt size for both the inventive and standard products was two inches wide by 132 inches long. The following data was obtained.

| CUT DATA FOR 1018 COLD ROLLED STEEL | | |
|---|---|---|
| | EDGE TEST NUMBER OF CONTACTS | CUT TEST GRAMS REMOVED |
| Inventive Belt | 8.5 | 955 |
| Cotton Control 1 | 5 | 882 |
| Cotton Control 2 | 3 | 884 |

These tests showed the base adhesion qualities (Edge Test), as well as stock removal capabilities (Cut Test). The polyester backed belts of the invention showed 2.8 times better base adhesion than the Cotton Control 2 and 1.7 times better base adhesion than the Cotton Control 1. It is believed that this is a result of the cloth finishing process, wherein thermosetting materials have been incorporated into the substrate to retain much of the original body, without embrittlement. On a percentage basis, the results showed the inventive belts to be 70% better than Cotton Control 1 and 167% better than Cotton Control 2. The capability of metal stock removal also is better in that the inventive belts are 8% better than both control products.

A unique capability of this non-waterproof heavyduty, all resin product made in accordance with the invention, is that it has the strength and toughness to withstand being doubled upon itself across the warp, grain side being compressed, without shattering. It cannot be torn readily across the warp manually, in the crease produced during the doubling process. On the other hand, coated abrasive belts with plain cotton as a standard substrate and finished with both natural and thermosetting high polymers, and made into an all resin product, as were the two controlled products, will just not stand up to this type of treatment, but will shatter first.

In addition, the inventive belts have been evaluated successfully in the field against competitive products, with the reports indicating at least a 75% success ratio ranging from 25% to 300% better in metal removal capabilities.

In some instances in the field, the inventive polyester backed belts with aluminum oxide grain was found to be better than competitive products having incorporated in their coated abrasive belts premium grain composed of zirconiaalumina, that is generally and normally known to out produce the regular aluminum oxide abrasive belts in both edge tests and in grinding performance.

EXAMPLE 2

The 100% polyester sateen fabric, heat set and destretched, as well as cloth finished as in Example 1, was made into a waterproof product for use as a coated abrasive where such a product is immersed in a predominantly aqueous solution in order to carry out the grinding operation. While the various coating and product finishing steps were the same as those used for Example 1, it was necessary to change the maker system so that the phenol-formaldehyde resin used to hold the grain did not lose its properties detrimentally when so used in an aqueous system. Thus, the maker composition of this Example was as follows.

| MAKER COAT FORMULATION | | | | |
|---|---|---|---|---|
| | WET | DRY | | % |
| Al 6164 resin | 550 | 451 | | 44.83 |
| $CaCO_3$ | 550 | 550 | | 54.67 |
| Span 20 | 3 | 3 | | 0.30 |
| Silane Z-6026 | 2.75 | 2 | (Prox) | 0.20 |
| TOTAL | 1,105.75 | 1,006 | | 100.00 |

NOTE:
The solids content was 91%. The maker was disposited by means of a roll coater at 19 pounds per ream, wet basis, and viscosity was 2,000 cps. For viscosity adjustment two parts of ethylene glycol monoethylether were used for 3 parts of water.

The physical properties of the Al 6164 phenol formaldehyde resin were: solids content, 82±3%; viscosity, 5,000±1,000 cps; G. E. Gel at 121° C., 6±1 minute, and pH at 25° C., 6.7±0.3. This resin can be obtained from Borden Chemical Company, Bainbridge, New York. The Silane Z-6026 (an adhesion promoter) may be purchased from Dow Corning Corporation in Cleveland, Ohio.

The ethylene glycol monoethylether had a specific gravity of 0.928±0.505, and may be purchased from Commercial Chemicals Inc., Buffalo, New York.

Grit 36 aluminum oxide grain was applied as in Example 1, but at about 57 pounds per ream and subsequently sized, using a two roll coater as it well known to those versed in the art. The size composition was as follows.

| | SIZE FORMULATION | | |
|---|---|---|---|
| | WET | DRY | % |
| A1 6164 resin | 550 | 451 | 44.83 |
| $CaCO_3$ | 550 | 550 | 54.67 |
| Span 20 | 3 | 3 | 0.30 |
| Silane Z-6026 | 2.75 | 2.75 | 0.2 |
| TOTAL | 1,105.75 | 1,006.75 | 100.00 |

NOTE:
The physical properties of this size composition were: solids content, 91%, viscosity, 2,000 cps; deposition, 29 pounds per ream, wet basis. The viscosity adjustment was the same as for the maker coat.

The sized belt forming matrix was then cured, flexed, slit to width and spliced in order to provide a waterproof product similar to that illustrated in FIG. 2, except that there was no pre-sizing required.

It is to be noted at this point that for both the non-waterproof product of Example 1 and the waterproof product of this Example 2, where a fine grit abrasive is employed (80 grit and finer), the front fill needs to be applied with a knife on web, rather than by a roll application. The back fill and back size remain the same. In this particular case, i.e., fine grit size, the front fill formulation is modified to the following.

| | WET | DRY | % |
|---|---|---|---|
| A1 6164 resin | 500 | 410 | 53.24 |
| $CaCO_3$ | 350 | 350 | 45.87 |
| Span 20 | 3 | 3 | 0.39 |
| TOTAL | 853 | 763 | 100.00 |

NOTE:
Solids content was 89%; viscosity was 3,250 ± 250 cps at 90° F., and the composition was deposited at 10 pounds per ream, wet basis. The viscosity adjustment was made using the same solution as with the A1 6164 resin maker and size solution.

The cloth was dried to a tack-free state and thereafter further processed in the same manner as in Example 1 to produce the desired coated abrasive belts containing abrasives of 80 grit size and finer.

EXAMPLE 3

The polyester fabric was heat set and destretched as in Example 1, except that the apparatus of FIGS. 6 and 7 was used. The knurled rolls had a surface speed of about 84 feet per minute, the tenter frame (i.e., chain and clip assemblies) had a surface speed of about 87 feet per minute, and the backing material was heated to about 440° F. fro about 1 minute, because the oven was about 90 feet long. However, to increase pliability, the back fill and backsize steps were eliminated and replaced with a dip filling operation in order to produce a belt having a cross-section such as that illustrated in FIG. 3.

The dip fill was composed of a 20% phenol-formaldehyde resin/water solution having the following formulation.

| | Wet | | Dry |
|---|---|---|---|
| Pre-size resin | 3,000 | grams | 100 grams |
| Water | 7,500 | grams | — |
| TOTAL | 10,500 | grams | 2,100 grams |

NOTE:
The solids content was 20%. The pre-size resin was as described above in Example 1.

The polyester substrate was immersed in this solution and subsequently squeezed between two rolls and dried. The dry add on was 1.3 pounds per ream. The cloth thus treated was given a second dip application for a total of 2.8 pounds per ream, dry pickup. A face or front fill coat of 60/40 phenol-formaldehyde resin/calcium carbonate at 1300 cps±100 cps at 90° F. was applied to the dip filled fabric to a dry deposition of 8±2 pounds per ream. This face fill was the same composition as employed in Example 1.

In order to compare the difference in processing between these two Examples, the following information is tabulated below.

| COMPARISON TO PHYSICALS IN EXAMPLE 1 | | |
|---|---|---|
| | Tensile Pli | Elongation at 170 pli |
| Polyester, BF, BS, FF | 472 | 4.8% |
| Polyester, dip fill, FF | 428 | 4.3% |

As is evident, the physical properties of the dip filled polyester as compared to that in Example 1 are quite adequate. Next, the dip filled fabric was processed in the same manner as for Example 1 in order to produce belts having a grit size of 36 aluminum oxide grain in an all resin system. Following this, the product of this Example was compared to those recorded in Example 1, with part of the data being repeated, below.

| CUT DATA FOR 1018 COLD ROLLED STEEL | | |
|---|---|---|
| | Edge Test Number of Contacts | Cut Test Grams |
| Example 1 | 8.5 | 955 |
| Example 3 | 6 | 918 |
| Cotton Control 1 | 5 | 882 |
| Cotton Control 2 | 3 | 884 |

From the data in the above table, it becomes evident that the cloth finishing plays a part in final performance because the dip filled product of this Example is not quite as good as the back sized, back filled product of Example 1. At the same time, the dip filled product is substantially superior to the Cotton Control 2 product. The edge test results of the above table are an indication of greater pliability in the dip filled product than in the back sized product, and this is an asset in areas where more pliability is a pre-requisite, so long as stock removal remains within acceptable limits.

EXAMPLE 4

The polyester fabric was heat set and destretched as in Example 3, but the double dip fill coat operation disclosed therein was replaced with a single dip to achieve satisfactory results where base adhesion is not a pre-requisite, as in Example 1, but a strong, rough backing is required. The single dip fill coat is composed of a 50% phenol-formaldehyde water solution having the following formulation

| | Wet | Dry |
|---|---|---|
| Pre-size resin (Ex. 1) | 10,000 | 7,000 |
| Water | 4,000 | |
| TOTAL | 14,000 | |

The polyester substrate was immersed in the solution and subsequently squeezed between two rolls and dried. The dried add-on weight was 3±0.5 pounds per ream.

A front fill or face fill coat of 60/40 phenol-formaldehyde resin/calcium carbonate at 1300 cps±100 cps at 90° F. was applied to the dip filled fabric to a dry deposition of 8±2 pounds per ream, and the formulation of and the properties of such resin compound was the same as for Example 1.

COMPARISON OF PHYSICAL PROPERTIES

| | Tensile pli | Elongation at 170 pli |
|---|---|---|
| Example 1 (control) Polyester BF, BS, FF | 472 | 4.8% |
| Example 3 (control) Polyester double dip and FF | 428 | 4.3% |
| Polyester single dip and FF | 428 | 4.4% |

The above comparison Table of physical properties shows that the single dip and double dip products are comparable, and quite adequate in comparison to the control product of Example 1 which had the back fill, back size and front fill coats.

The single dip filled cloth finished product was then processed to form belts in the same manner as set forth in Example 3, in order to produce a 36 grit aluminum oxide all resin product and resulting belts.

The product thus made was compared to the inventive control product as set forth below.

CUT DATA
1018 COLD ROLLED STEEL

| | Edge Test Number of Contacts | Grams of Steel Removed |
|---|---|---|
| Polyester single dip | 16 | 679 |
| Polyester BF, BS, FF (control of Ex. 1) | 16 + | 826 |

These above tabulated results show that the single dip filled product does not have quite the base adhesion of the inventive polyester control product of Example 1. Also, these results indicate that the flat cut is better on the product which has more body, namely the inventive product of Example 1.

At the same time, this single dip product has been successfully field tested as a SiC resin cloth on glass.

EXAMPLE 5

The 100% polyester sateen fabric heat set and destretched as in Example 3, and cloth finished as in Example 4 was made into a waterproof product for use as a coated abrasive belt, where such a product is immersed in a predominantly aqueous solution to carry out the grinding operation. In this case the maker system was changed, as in Example 2, so that the phenol-formaldehyde resin employed to hold the grain did not lose its properties detrimentally when used with such aqueous system.

The only other difference between the product of this Example and that of Example 4 was that a fine grit silicon carbide grain the belt product was employed. This grain had a size of 80 grit and was deposited at about 24 pounds per ream, and the belt product was evaluated in comparison to a control waterproof belt product of the invention in the same grit where the cloth finish was back filled, back sized and front filled. The results in glass grinding were as follows:

TABLE III

| | Glass Grams Removed | Inches Stretch |
|---|---|---|
| Polyester waterproof control | 126 | 3/32 |
| Polyester two pass process (dip plus front fill) | 130 | 2/32 |

These results show at least comparable cut and stretch during use of the two pass product in comparison to the polyester control.

It now will be seen how the invention accomplishes its various objectives, and likewise, the advantages inherent therein have become apparent. It further is to be understood that the various preferred embodiments referred to herein are to be considered in the illustrative sense rather than in the limiting sense, and that the scope of the invention is to be defined by the appended claims.

We claim:

1. A coated abrasive product incorporating the backing material provided with a cloth finish including fill and front fill coats containing thermosetting resin, said product having successive maker, abrasive and size coats over said front fill coat, said maker and size coats containing thermosetting resin, and said product being cured and able to withstand being doubled upon itself across the warp, abrasive side compressed, without shattering, and without being torn readily across the warp manually, in the crease produced during such doubling.

2. A method of heat setting and destretching a fabric backing material for a coated abrasive product, said method comprising: providing a backing material woven from 100% high tenacity polyester fibers in a sateen weave, with a fabric cover of more than about 96%, maintaining said backing material under both warpwise and weftwise tension while heating to a temperature and for a time sufficient to increase its fabric cover to more than about 99% and to provide said backing material with a dimensional stability warpwise of less than about 6.5% elongation at 170 pounds per linear inch of width tensile while maintaining its desired width during said heat setting and destretching.

3. The method of claim 2 wherein said warpwise tension is sufficient to provide an average length increase of more than about 4%, and said weftwise tension is sufficient to limit the average width decrease to about 5%.

4. A heat set and destretched fabric backing material for a coated abrasive product, said backing material being woven from 100% high tenacity polyester fibers in a sateen weave, with a fabric cover of more than about 96%, and following heat setting and destretching, having its fabric cover increased to more than about 99% and a dimensional stability warpwise of less than about 6.5% elongation at 170 pounds per linear inch of width tensile.

* * * * *

UNITED STATES PATENT OFFICE

CERTIFICATE OF CORRECTION

PATENT NO. : 4,225,321

DATED : September 30, 1980

INVENTOR(S) : Henry J. Swiatek

It is certified that error appears in the above-identified patent and that said Letters Patent are hereby corrected as shown below:

In claim 1, line 2, after "material" insert --of claim 4--.

Signed and Sealed this

*Twenty-seventh* Day of *January 1981*

[SEAL]

*Attest:*

RENE D. TEGTMEYER

*Attesting Officer*

*Acting Commissioner of Patents and Trademarks*